US011064725B2

(12) United States Patent
Wilke et al.

(10) Patent No.: US 11,064,725 B2
(45) Date of Patent: Jul. 20, 2021

(54) MATERIAL FOR USE WITH APPARATUS FOR HEATING SMOKABLE MATERIAL

(71) Applicant: BRITISH AMERICAN TOBACCO (INVESTMENTS) LIMITED, London (GB)

(72) Inventors: Andrew P. Wilke, Madison, WI (US); Duane A. Kaufman, Hollandale, WI (US); Raymond J. Robey, Madison, WI (US); John A. Miller, Marshall, WI (US); Benjamin J. Paprocki, Cottage Grove, WI (US)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 464 days.

(21) Appl. No.: 15/754,837

(22) PCT Filed: Aug. 26, 2016

(86) PCT No.: PCT/EP2016/070191
§ 371 (c)(1),
(2) Date: Feb. 23, 2018

(87) PCT Pub. No.: WO2017/036959
PCT Pub. Date: Mar. 9, 2017

(65) Prior Publication Data

US 2018/0242633 A1 Aug. 30, 2018

Related U.S. Application Data

(63) Continuation of application No. 14/840,972, filed on Aug. 31, 2015, now abandoned.

(51) Int. Cl.
*A24F 47/00* (2020.01)
*A24B 15/16* (2020.01)
(Continued)

(52) U.S. Cl.
CPC ..... *A24B 15/16* (2013.01); *A24C 5/01* (2020.01); *A24D 1/20* (2020.01); *A24F 40/465* (2020.01); *H05B 6/105* (2013.01)

(58) Field of Classification Search
CPC ..... A24F 47/004; A24F 47/008; A24F 15/00; A24F 15/01; A24F 15/015; A24F 40/00;
(Continued)

(56) References Cited

U.S. PATENT DOCUMENTS 219,628 A 9/1879 Edison
219,634 A 9/1879 Gifford
(Continued)

FOREIGN PATENT DOCUMENTS

AT 262137 B 5/1968
AT 306224 B 3/1973
(Continued)

OTHER PUBLICATIONS

Application and File History for U.S. Appl. No. 14/428,626, filed Mar. 16, 2015, Inventors Hatrick et al.
(Continued)

*Primary Examiner* — Tuan N Nguyen
(74) *Attorney, Agent, or Firm* — Patterson Thuente Pedersen, P.A.

(57) ABSTRACT

Disclosed is material for use with apparatus for heating smokable material to volatilize at least one component of the smokable material. The material includes a mixture of smokable material and elements. Each of the elements includes a closed circuit of heating material that is heatable by penetration with a varying magnetic field.

10 Claims, 3 Drawing Sheets

(51) Int. Cl.

| | |
|---|---|
| ***H05B 6/10*** | (2006.01) |
| ***A24C 5/01*** | (2020.01) |
| ***A24D 1/20*** | (2020.01) |
| ***A24F 40/465*** | (2020.01) |

(58) Field of Classification Search

CPC ..... A24F 40/05; A24F 40/10; A24F 40/20; A24F 40/30; A24F 40/40; A24F 40/42; A24F 40/44; A24F 40/46; A24F 40/465; A24F 40/48; A24F 40/485; A24F 40/49; A24F 40/50; A24F 40/51; A24F 40/53; A24F 40/57; A24F 40/60; A24F 40/65; A24F 40/70; A24F 40/80; A24F 40/85; A24F 40/90; A24F 40/95; A24B 15/16; H05B 6/105; A24D 3/17; A24D 1/22; A24C 5/01

USPC ..... 219/634

See application file for complete search history.

(56) References Cited

U.S. PATENT DOCUMENTS 219,635 A 9/1879 Giles
219,643 A 9/1879 Mattoni
2,462,563 A 2/1949 Seyforth
2,689,150 A 9/1954 Croce
2,888,208 A 5/1959 Rene et al.
3,040,991 A 6/1962 Rene et al.
3,043,524 A 7/1962 Sonia et al.
3,144,174 A 8/1964 Henry et al.
3,258,015 A 6/1966 Drummond et al.
3,289,949 A 12/1966 Willy et al.
3,347,231 A 10/1967 Chien-Hshuing et al.
3,522,806 A 8/1970 Szekely et al.
3,647,143 A 3/1972 Gauthier et al.
3,658,059 A 4/1972 Steil
3,733,010 A 5/1973 Riccio
3,856,185 A 12/1974 Riccio
3,864,326 A 2/1975 Babington
3,913,843 A 10/1975 Cambio, Jr.
3,943,942 A 3/1976 Anderson et al.
4,017,701 A 4/1977 Mittelmann
4,149,548 A 4/1979 Bradshaw
4,284,089 A 8/1981 Ray
4,299,274 A 11/1981 Campbell
4,299,355 A 11/1981 Hakkinen
4,303,541 A 12/1981 Wasel-Nielen et al.
4,393,884 A 7/1983 Jacobs
4,429,835 A 2/1984 Brugger et al.
4,746,067 A 5/1988 Svoboda
4,765,347 A 8/1988 Sensabaugh, Jr. et al.
4,765,348 A 8/1988 Honeycutt
4,771,795 A 9/1988 White et al.
4,776,353 A 10/1988 Lilja et al.
4,819,665 A 4/1989 Roberts et al.
4,827,950 A 5/1989 Banerjee et al.
4,907,606 A 3/1990 Lilja et al.
4,913,168 A 4/1990 Potter et al.
4,917,119 A 4/1990 Potter et al.
4,917,120 A 4/1990 Hill
4,924,883 A 5/1990 Perfetti et al.
4,938,236 A 7/1990 Banerjee et al.
4,941,483 A 7/1990 Ridings et al.
4,947,874 A 8/1990 Brooks et al.
4,955,399 A 9/1990 Potter et al.
4,979,521 A 12/1990 Davis et al.
4,987,291 A 1/1991 McGaffigan et al.
4,991,606 A 2/1991 Serrano et al.
5,019,122 A 5/1991 Clearman et al.
5,020,509 A 8/1991 Suzuki et al.
5,040,552 A 8/1991 Schleich et al.
5,042,509 A 8/1991 Banerjee et al.
5,060,667 A 10/1991 Strubel
5,060,671 A 10/1991 Counts et al.
5,076,292 A 12/1991 Sensabaugh, Jr. et al.
5,080,115 A 1/1992 Templeton
5,093,894 A 3/1992 Deevi et al.
5,095,921 A 3/1992 Losee et al.
5,097,850 A 3/1992 Braunshteyn et al.
5,099,861 A 3/1992 Clearman et al.
5,105,831 A 4/1992 Banerjee et al.
5,119,834 A 6/1992 Shannon et al.
5,133,368 A 7/1992 Neumann et al.
5,144,962 A 9/1992 Counts et al.
5,146,934 A 9/1992 Deevi et al.
5,159,940 A 11/1992 Hayward et al.
5,167,242 A 12/1992 Turner et al.
5,179,966 A 1/1993 Losee et al.
5,188,130 A 2/1993 Hajaligol et al.
5,224,498 A 7/1993 Deevi et al.
5,230,715 A 7/1993 Iizuna et al.
5,235,992 A 8/1993 Sensabaugh, Jr.
5,249,586 A 10/1993 Morgan et al.
5,261,424 A 11/1993 Sprinkel, Jr.
5,269,327 A 12/1993 Counts et al.
5,272,216 A 12/1993 Clark, Jr. et al.
5,285,798 A 2/1994 Banerjee et al.
5,293,883 A 3/1994 Edwards
5,312,046 A 5/1994 Knoch et al.
5,322,075 A 6/1994 Deevi et al.
5,327,915 A 7/1994 Porenski et al.
5,345,951 A 9/1994 Serrano et al.
5,357,984 A 10/1994 Farrier et al.
5,369,723 A 11/1994 Counts et al.
5,396,911 A 3/1995 Casey, III et al.
5,400,808 A 3/1995 Turner et al.
5,408,574 A 4/1995 Deevi et al.
5,412,183 A 5/1995 Buffenoir et al.
5,415,186 A 5/1995 Casey, III et al.
5,443,560 A 8/1995 Deevi et al.
5,454,363 A 10/1995 Sata
5,461,695 A 10/1995 Knoch
5,474,059 A 12/1995 Cooper
5,483,953 A 1/1996 Cooper
5,500,511 A 3/1996 Hansen et al.
5,501,236 A 3/1996 Hill et al.
5,502,743 A 3/1996 Conochie et al.
5,511,538 A 4/1996 Haber et al.
5,517,981 A 5/1996 Taub et al.
5,534,020 A 7/1996 Cheney, III et al.
5,538,020 A 7/1996 Farrier et al.
5,549,906 A 8/1996 Santus
5,564,442 A 10/1996 MacDonald et al.
5,591,368 A 1/1997 Fleischhauer et al.
5,593,792 A 1/1997 Farrier et al.
5,613,505 A 3/1997 Campbell et al.
5,645,749 A 7/1997 Wang
5,649,554 A 7/1997 Sprinkel et al.
5,659,656 A 8/1997 Das
5,687,912 A 11/1997 Denyer
5,699,786 A 12/1997 Oshima et al.
5,711,292 A 1/1998 Hammarlund
5,726,421 A 3/1998 Fleischhauer et al.
5,736,110 A 4/1998 Angelillo et al.
5,778,899 A 7/1998 Saito et al.
5,837,088 A 11/1998 Palmgren et al.
5,845,649 A 12/1998 Saito et al.
5,865,185 A 2/1999 Collins et al.
5,865,186 A 2/1999 Volsey, II
5,878,752 A 3/1999 Adams et al.
5,902,501 A 5/1999 Nunnally et al.
5,921,233 A 7/1999 Gold et al.
5,935,486 A 8/1999 Bell et al.
5,938,125 A 8/1999 Ritsche et al.
6,000,394 A 12/1999 Blaha-Schnabel et al.
6,026,820 A 2/2000 Baggett, Jr. et al.
6,041,790 A 3/2000 Smith et al.
6,053,176 A 4/2000 Adams et al.
6,079,405 A 6/2000 Justo
6,085,741 A 7/2000 Becker
6,089,857 A 7/2000 Matsuura et al.
6,113,078 A 9/2000 Rock
6,125,853 A 10/2000 Susa et al.

(56) References Cited

U.S. PATENT DOCUMENTS 6,129,080 A 10/2000 Pitcher et al.
6,158,676 A 12/2000 Hughes
6,164,287 A 12/2000 White
6,178,963 B1 1/2001 Baik
6,209,457 B1 4/2001 Kenworthy et al.
6,223,745 B1 5/2001 Hammarlund et al.
6,230,703 B1 5/2001 Bono
6,234,459 B1 5/2001 Rock
6,244,573 B1 6/2001 Rock
6,248,257 B1 6/2001 Bell et al.
6,267,110 B1 7/2001 Tenenboum et al.
6,283,116 B1 9/2001 Yang
6,289,889 B1 9/2001 Bell et al.
6,297,483 B2 10/2001 Sadahira et al.
6,347,789 B1 2/2002 Rock
6,427,878 B1 8/2002 Greiner-Perth et al.
6,595,209 B1 7/2003 Rose et al.
6,598,607 B2 7/2003 Adiga et al.
6,648,306 B2 11/2003 Rock
6,669,176 B2 12/2003 Rock
6,708,846 B1 3/2004 Fuchs et al.
6,761,164 B2 7/2004 Amirpour et al.
6,769,436 B2 8/2004 Horian
6,799,572 B2 10/2004 Nichols et al.
6,803,545 B2 10/2004 Blake et al.
6,803,550 B2 10/2004 Sharpe et al.
6,886,556 B2 5/2005 Fuchs
6,968,888 B2 11/2005 Kolowich
6,994,096 B2 2/2006 Rostami et al.
7,041,123 B2 5/2006 Stapf et al.
7,077,130 B2 7/2006 Nichols et al.
7,081,211 B2 7/2006 Li et al.
7,088,914 B2 8/2006 Whittle et al.
7,163,014 B2 1/2007 Nichols et al.
7,185,659 B2 3/2007 Sharpe
7,234,459 B2 6/2007 Del Bon
7,235,187 B2 6/2007 Li et al.
7,290,549 B2 11/2007 Banerjee et al.
7,303,328 B2 12/2007 Faraldi et al.
7,335,186 B2 2/2008 O'Neil
7,373,938 B2 5/2008 Nichols et al.
7,434,584 B2 10/2008 Steinberg
7,458,374 B2 12/2008 Hale et al.
7,540,286 B2 6/2009 Cross et al.
7,581,540 B2 9/2009 Hale et al.
7,581,718 B1 9/2009 Chang
7,585,493 B2 9/2009 Hale et al.
7,645,442 B2 1/2010 Hale et al.
7,665,461 B2 2/2010 Zierenberg et al.
7,832,397 B2 11/2010 Lipowicz
7,834,295 B2 11/2010 Sharma et al.
7,987,846 B2 8/2011 Hale et al.
8,156,944 B2 4/2012 Han
8,342,184 B2 1/2013 Inagaki et al.
8,365,742 B2 2/2013 Hon
8,375,957 B2 2/2013 Hon
8,402,976 B2 3/2013 Fernando et al.
8,439,046 B2 5/2013 Peters et al.
8,459,271 B2 6/2013 Inagaki
8,689,804 B2 4/2014 Fernando et al.
8,689,805 B2 4/2014 Hon
8,701,682 B2 4/2014 Sherwood et al.
8,707,967 B2 4/2014 Li et al.
9,084,440 B2 * 7/2015 Zuber ..... A24F 47/008
9,125,437 B2 9/2015 Kaljura
9,302,522 B2 4/2016 Sherwood et al.
9,439,454 B2 9/2016 Fernando et al.
9,668,516 B2 6/2017 Sherwood et al.
9,955,726 B2 5/2018 Brinkley et al.
10,130,121 B2 11/2018 Plojoux et al.
10,130,780 B2 11/2018 Talon
2001/0042927 A1 11/2001 Rock
2001/0054421 A1 12/2001 Jaser et al.
2002/0043260 A1 4/2002 Layer et al.
2002/0078951 A1 6/2002 Nichols et al.
2002/0078955 A1 6/2002 Nichols et al.
2002/0078956 A1 6/2002 Sharpe et al.
2002/0089072 A1 7/2002 Rock
2002/0121624 A1 9/2002 Usui
2003/0007887 A1 1/2003 Roumpos et al.
2003/0052196 A1 3/2003 Fuchs
2003/0097164 A1 5/2003 Stapf et al.
2003/0101984 A1 6/2003 Li et al.
2003/0105192 A1 6/2003 Li et al.
2003/0106551 A1 6/2003 Sprinkel, Jr. et al.
2003/0111637 A1 6/2003 Li et al.
2003/0159702 A1 8/2003 Lindell et al.
2003/0209240 A1 11/2003 Hale et al.
2003/0217750 A1 11/2003 Amirpour et al.
2003/0226837 A1 12/2003 Blake et al.
2003/0230567 A1 12/2003 Centanni et al.
2004/0031495 A1 2/2004 Steinberg
2004/0065314 A1 4/2004 Layer et al.
2004/0068222 A1 4/2004 Brian
2004/0083755 A1 5/2004 Kolowich
2004/0149297 A1 8/2004 Sharpe
2004/0177849 A1 9/2004 Del Bon
2004/0234699 A1 11/2004 Hale et al.
2004/0234914 A1 11/2004 Hale et al.
2004/0234916 A1 11/2004 Hale et al.
2004/0255941 A1 12/2004 Nichols et al.
2004/0261782 A1 12/2004 Furumichi et al.
2005/0007870 A1 1/2005 Faraldi et al.
2005/0016549 A1 1/2005 Banerjee et al.
2005/0025213 A1 2/2005 Parks
2005/0045193 A1 3/2005 Yang
2005/0063686 A1 3/2005 Whittle et al.
2005/0079166 A1 4/2005 Damani et al.
2005/0098187 A1 5/2005 Grierson et al.
2005/0133029 A1 6/2005 Nichols et al.
2005/0196345 A1 9/2005 Diederichs et al.
2005/0236006 A1 10/2005 Cowan
2006/0027233 A1 2/2006 Zierenberg et al.
2006/0032501 A1 2/2006 Hale et al.
2006/0043067 A1 3/2006 Kadkhodayan et al.
2006/0102175 A1 5/2006 Nelson
2006/0118128 A1 6/2006 Hoffmann et al.
2006/0137681 A1 6/2006 Von Hollen et al.
2006/0191546 A1 8/2006 Takano et al.
2006/0196518 A1 9/2006 Hon
2006/0196885 A1 9/2006 Leach et al.
2006/0255029 A1 11/2006 Bone, Jr.
2007/0023043 A1 2/2007 Von Hollen et al.
2007/0028916 A1 2/2007 Hale et al.
2007/0031340 A1 2/2007 Hale et al.
2007/0102533 A1 5/2007 Rosell et al.
2007/0125362 A1 6/2007 Ford et al.
2007/0131219 A1 6/2007 Ford et al.
2007/0138207 A1 6/2007 Bonney et al.
2007/0175476 A1 8/2007 Lipowicz
2007/0204864 A1 9/2007 Grychowski et al.
2007/0222112 A1 9/2007 Christ et al.
2007/0235046 A1 10/2007 Gedevanishvili
2007/0267407 A1 11/2007 Loveless et al.
2007/0283972 A1 12/2007 Monsees et al.
2007/0289720 A1 12/2007 Sunol et al.
2008/0027694 A1 1/2008 Gitman
2008/0031267 A1 2/2008 Imao
2008/0038363 A1 2/2008 Zaffaroni et al.
2008/0149118 A1 6/2008 Oglesby et al.
2008/0156326 A1 7/2008 Belcastro et al.
2008/0216828 A1 9/2008 Wensley et al.
2008/0241255 A1 10/2008 Rose et al.
2008/0257367 A1 10/2008 Paterno et al.
2008/0276947 A1 11/2008 Martzel
2008/0312674 A1 12/2008 Chen et al.
2009/0015717 A1 1/2009 Arnao et al.
2009/0071477 A1 3/2009 Hale et al.
2009/0078711 A1 3/2009 Farone et al.
2009/0090349 A1 4/2009 Donovan
2009/0090351 A1 4/2009 Sunol et al.
2009/0095287 A1 4/2009 Emarlou
2009/0107492 A1 4/2009 Ooida
2009/0114215 A1 5/2009 Boeck et al.

(56) References Cited

U.S. PATENT DOCUMENTS

2009/0127253 A1 5/2009 Stark et al.
2009/0151717 A1 6/2009 Bowen et al.
2009/0162294 A1 6/2009 Werner
2009/0180968 A1 7/2009 Hale et al.
2009/0199843 A1 8/2009 Farone et al.
2009/0217923 A1 9/2009 Boehm et al.
2009/0230117 A1 9/2009 Fernando et al.
2009/0255923 A1 10/2009 Buehrer et al.
2009/0260641 A1 10/2009 Monsees et al.
2009/0260642 A1 10/2009 Monsees et al.
2009/0280043 A1 11/2009 Ferguson
2009/0301363 A1 12/2009 Damani et al.
2009/0301471 A1 12/2009 Stirzel
2009/0302019 A1 12/2009 Selenski et al.
2010/0006092 A1 1/2010 Hale et al.
2010/0025023 A1 2/2010 Schmidt et al.
2010/0031968 A1 2/2010 Sheikh et al.
2010/0043809 A1 2/2010 Magnon
2010/0065052 A1 3/2010 Sharma et al.
2010/0068154 A1 3/2010 Sharma et al.
2010/0089381 A1 4/2010 Bolmer et al.
2010/0181387 A1 7/2010 Zaffaroni et al.
2010/0236546 A1 9/2010 Yamada et al.
2010/0242974 A1 9/2010 Pan
2010/0258585 A1 10/2010 Jamison
2010/0268212 A1 10/2010 Manwaring et al.
2010/0300467 A1 12/2010 Kuistila et al.
2010/0307518 A1 12/2010 Wang
2010/0313901 A1 12/2010 Fernando et al.
2011/0005535 A1 1/2011 Xiu
2011/0030671 A1 2/2011 Ferguson et al.
2011/0192408 A1 8/2011 Inagaki et al.
2011/0240022 A1 10/2011 Hodges et al.
2011/0283458 A1 11/2011 Gillette et al.
2011/0290266 A1 12/2011 Koller
2011/0303230 A1 12/2011 Thiry
2012/0006342 A1 1/2012 Rose et al.
2012/0006343 A1 1/2012 Renaud et al.
2012/0145189 A1 6/2012 Knopow et al.
2012/0234315 A1 9/2012 Li et al.
2013/0061861 A1 3/2013 Hearn
2013/0133675 A1 5/2013 Shinozaki et al.
2013/0152922 A1 6/2013 Benassayag et al.
2014/0196716 A1 7/2014 Liu
2014/0216482 A1 8/2014 Dotan et al.
2014/0238737 A1 8/2014 Backman
2015/0245669 A1 9/2015 Cadieux et al.
2015/0272219 A1 10/2015 Hatrick et al.
2015/0282256 A1 10/2015 Iguro et al.
2015/0302971 A1 10/2015 Wagman et al.
2015/0320116 A1 11/2015 Bleloch et al.
2016/0036222 A1 2/2016 Templeton et al.
2016/0044963 A1 2/2016 Saleem
2016/0150825 A1* 6/2016 Mironov ..... H05B 6/06 219/634
2016/0150828 A1 6/2016 Goldstein et al.
2017/0055574 A1 3/2017 Kaufman et al.
2017/0055575 A1 3/2017 Wilke et al.
2017/0055580 A1 3/2017 Blandino et al.
2017/0055581 A1 3/2017 Wilke et al.
2017/0055582 A1 3/2017 Blandino et al.
2017/0055583 A1 3/2017 Blandino et al.
2017/0055584 A1 3/2017 Blandino et al.
2017/0071250 A1* 3/2017 Mironov ..... A24F 47/008
2017/0079325 A1 3/2017 Mironov
2017/0119046 A1 5/2017 Kaufman et al.
2017/0119047 A1 5/2017 Blandino et al.
2017/0119048 A1 5/2017 Kaufman et al.
2017/0119049 A1 5/2017 Blandino et al.
2017/0119050 A1 5/2017 Blandino et al.
2017/0119051 A1 5/2017 Blandino et al.
2017/0119054 A1 5/2017 Zinovik et al.
2017/0156403 A1 6/2017 Gill et al.
2018/0235279 A1 8/2018 Wilke et al.
2018/0242636 A1 8/2018 Blandino et al.
2018/0249760 A1 9/2018 Kaufman et al.
2018/0279677 A1 10/2018 Blandino et al.
2018/0317552 A1 11/2018 Kaufman et al.
2018/0317553 A1 11/2018 Blandino et al.
2018/0317554 A1 11/2018 Kaufman et al.
2018/0317555 A1 11/2018 Blandino et al.
2018/0325173 A1 11/2018 Blandino et al.
2019/0082738 A1 3/2019 Blandino et al.
2019/0191780 A1 6/2019 Wilke et al.
2019/0239555 A1 8/2019 Nicholson
2019/0313695 A1 10/2019 Kaufman et al.
2019/0364973 A1 12/2019 Kaufman et al.
2020/0054068 A1 2/2020 Blandino et al.
2020/0054069 A1 2/2020 Blandino et al.

FOREIGN PATENT DOCUMENTS

AT 321190 B 3/1975
AT 321191 B 3/1975
AU 2002364521 A1 6/2003
CA 2160990 A1 10/1994
CA 2146954 A1 10/1996
CA 2414161 A1 1/2002
CA 2414191 A1 1/2002
CA 2520759 A1 10/2004
CA 2492255 A1 7/2006
CA 2668465 A1 12/2009
CA 2641869 A1 5/2010
CA 2862048 A1 7/2013
CA 2923377 A1 6/2015
CH 513656 A 10/1971
CH 698603 B1 9/2009
CL 2017003408 A1 6/2018
CN 1038085 A 12/1989
CN 1045691 A 10/1990
CN 1059649 A 3/1992
CN 2144261 Y 10/1993
CN 1121385 A 4/1996
CN 1123000 A 5/1996
CN 1123001 A 5/1996
CN 1126426 A 7/1996
CN 1158757 A 9/1997
CN 1195270 A 10/1998
CN 1209731 A 3/1999
CN 1043076 A 6/1999
CN 1287890 A 3/2001
CN 1293591 A 5/2001
CN 1293596 A 5/2001
CN 1130109 C 12/2003
CN 1130137 C 12/2003
CN 1151739 C 6/2004
CN 1575135 A 2/2005
CN 1641976 A 7/2005
CN 201078006 Y 6/2008
CN 101277622 A 10/2008
CN 101390659 A 3/2009
CN 201199922 Y 3/2009
CN 201445686 U 5/2010
CN 101925309 A 12/2010
CN 102212340 A 10/2011
CN 102483237 A 5/2012
CN 102499466 A 6/2012
CN 202351223 U 7/2012
CN 203369386 A 1/2014
CN 103608619 A 2/2014
CN 103689812 A 4/2014
CN 103689815 A 4/2014
CN 103763954 A 4/2014
CN 103974640 A 8/2014
CN 103997922 A 8/2014
CN 104010531 A 8/2014
CN 203761188 U 8/2014
CN 203762288 U 8/2014
CN 104039183 A 9/2014
CN 104095291 A 10/2014
CN 104095293 A 10/2014
CN 104095295 A 10/2014
CN 104203016 A 12/2014
CN 104223359 A 12/2014

(56) References Cited

FOREIGN PATENT DOCUMENTS

| | | | |
|---|---|---|---|
| CN | 104256899 | A | 1/2015 |
| CN | 204091003 | U | 1/2015 |
| CN | 104619202 | A | 5/2015 |
| CN | 104664608 | A | 6/2015 |
| CN | 104720121 | A | 6/2015 |
| CN | 204949521 | U | 1/2016 |
| DE | 360431 | C | 10/1922 |
| DE | 1100884 | B | 3/1961 |
| DE | 1425872 | A1 | 11/1968 |
| DE | 1290499 | B | 3/1969 |
| DE | 1813993 | A1 | 6/1970 |
| DE | 1425871 | B1 | 10/1970 |
| DE | 2315789 | A1 | 10/1973 |
| DE | 4105370 | A1 | 8/1992 |
| DE | 4307144 | C2 | 1/1995 |
| DE | 4343578 | A1 | 6/1995 |
| DE | 29509286 | U1 | 8/1995 |
| DE | 4420366 | A1 | 12/1995 |
| DE | 29700307 | U1 | 4/1997 |
| DE | 19854007 | A1 | 5/2000 |
| DE | 19854009 | A1 | 5/2000 |
| DE | 10058642 | A1 | 6/2001 |
| DE | 10007521 | A1 | 8/2001 |
| DE | 10064288 | A1 | 8/2001 |
| DE | 10165487 | A1 | 7/2003 |
| DE | 102005024803 | A1 | 6/2006 |
| DE | 202006013439 | U1 | 10/2006 |
| DE | 102005056885 | A1 | 5/2007 |
| DE | 102006041544 | A1 | 8/2007 |
| DE | 102006041042 | A1 | 3/2008 |
| DE | 102006047146 | A1 | 4/2008 |
| DE | 102007011120 | A1 | 9/2008 |
| DE | 102008034509 | A1 | 4/2009 |
| DE | 102008013303 | A1 | 9/2009 |
| DE | 202009010400 | U1 | 11/2009 |
| DE | 102008038121 | A1 | 2/2010 |
| DE | 202010011436 | U1 | 11/2010 |
| DK | 114399 | B | 6/1969 |
| DK | 488488 | A | 3/1989 |
| DK | 0540774 | T3 | 7/1995 |
| DK | 0540775 | T3 | 8/1997 |
| EP | 0033668 | A1 | 8/1981 |
| EP | 0076897 | A1 | 4/1983 |
| EP | 0033668 | B1 | 6/1983 |
| EP | 0149997 | A2 | 7/1985 |
| EP | 0194257 | A1 | 9/1986 |
| EP | 0371285 | A2 | 6/1990 |
| EP | 0418484 | A2 | 3/1991 |
| EP | 0430559 | A2 | 6/1991 |
| EP | 0430566 | A2 | 6/1991 |
| EP | 0503767 | A1 | 9/1992 |
| EP | 0503794 | A1 | 9/1992 |
| EP | 0520231 | A2 | 12/1992 |
| EP | 0703735 | A1 | 4/1996 |
| EP | 0354661 | B1 | 4/1997 |
| EP | 0540775 | B1 | 7/1997 |
| EP | 0824927 | A2 | 2/1998 |
| EP | 0857431 | A1 | 8/1998 |
| EP | 0653218 | B1 | 9/1998 |
| EP | 1064083 | A2 | 1/2001 |
| EP | 1064101 | A2 | 1/2001 |
| EP | 1111191 | A2 | 6/2001 |
| EP | 0703735 | B1 | 7/2001 |
| EP | 1128741 | A1 | 9/2001 |
| EP | 1128742 | A1 | 9/2001 |
| EP | 1148905 | A2 | 10/2001 |
| EP | 1203189 | A1 | 5/2002 |
| EP | 1217320 | A2 | 6/2002 |
| EP | 1298993 | A | 4/2003 |
| EP | 1299499 | A1 | 4/2003 |
| EP | 1299500 | A2 | 4/2003 |
| EP | 1301152 | A2 | 4/2003 |
| EP | 1357025 | A2 | 10/2003 |
| EP | 1357025 | B1 | 10/2003 |
| EP | 1390112 | A1 | 2/2004 |
| EP | 1409051 | A2 | 4/2004 |
| EP | 1439876 | A2 | 7/2004 |
| EP | 1454840 | A1 | 9/2004 |
| EP | 1490452 | A2 | 12/2004 |
| EP | 1506792 | A2 | 2/2005 |
| EP | 1609376 | A1 | 12/2005 |
| EP | 1625334 | A2 | 2/2006 |
| EP | 1625335 | A2 | 2/2006 |
| EP | 1625336 | A2 | 2/2006 |
| EP | 1454840 | B1 | 9/2006 |
| EP | 1536703 | B1 | 9/2006 |
| EP | 1702639 | A2 | 9/2006 |
| EP | 1749548 | A2 | 2/2007 |
| EP | 1867357 | A1 | 12/2007 |
| EP | 1891867 | A2 | 2/2008 |
| EP | 1940254 | A2 | 7/2008 |
| EP | 1996880 | A2 | 12/2008 |
| EP | 2044967 | A1 | 4/2009 |
| EP | 1357025 | B1 | 7/2009 |
| EP | 2083642 | A1 | 8/2009 |
| EP | 2110034 | A1 | 10/2009 |
| EP | 2138058 | A1 | 12/2009 |
| EP | 2138059 | A1 | 12/2009 |
| EP | 2179229 | A2 | 4/2010 |
| EP | 2191735 | A1 | 6/2010 |
| EP | 2227973 | A1 | 9/2010 |
| EP | 2234508 | A2 | 10/2010 |
| EP | 2241203 | A2 | 10/2010 |
| EP | 2138057 | B1 | 11/2010 |
| EP | 2246086 | A2 | 11/2010 |
| EP | 2249669 | A1 | 11/2010 |
| EP | 2253541 | A1 | 11/2010 |
| EP | 2257195 | A1 | 12/2010 |
| EP | 2277398 | A1 | 1/2011 |
| EP | 2303043 | A2 | 4/2011 |
| EP | 2316286 | A1 | 5/2011 |
| EP | 2327318 | A1 | 6/2011 |
| EP | 2368449 | A1 | 9/2011 |
| EP | 2003997 | B1 | 10/2011 |
| EP | 2408494 | A1 | 1/2012 |
| EP | 2444112 | A1 | 4/2012 |
| EP | 2253541 | B1 | 5/2012 |
| EP | 2472185 | A1 | 7/2012 |
| EP | 2523752 | A1 | 11/2012 |
| EP | 2542131 | A2 | 1/2013 |
| EP | 2760303 | A2 | 8/2014 |
| EP | 2907397 | A | 8/2015 |
| ES | 262308 | U | 6/1982 |
| FR | 718708 | A | 1/1932 |
| FR | 1418189 | A | 11/1965 |
| FR | 2573985 | A1 | 6/1986 |
| FR | 2604093 | A1 | 3/1988 |
| FR | 2700697 | A1 | 7/1994 |
| FR | 2730166 | A1 | 8/1996 |
| FR | 2818152 | A1 | 6/2002 |
| FR | 2842791 | B1 | 4/2005 |
| FR | 2873584 | B1 | 11/2006 |
| GB | 347650 | A | 4/1931 |
| GB | 353745 | A | 7/1931 |
| GB | 910166 | A | 11/1962 |
| GB | 922310 | A | 3/1963 |
| GB | 958867 | A | 5/1964 |
| GB | 1104214 | A | 2/1968 |
| GB | 1227333 | A | 4/1971 |
| GB | 1379688 | A | 1/1975 |
| GB | 1431334 | A | 4/1976 |
| GB | 2294401 | A | 5/1996 |
| GB | 2323033 | A | 9/1998 |
| GB | 2342874 | A | 4/2000 |
| GB | 2388040 | A | 11/2003 |
| GB | 2412326 | A | 9/2005 |
| GB | 2412876 | A | 10/2005 |
| GB | 2448478 | A | 10/2008 |
| GB | 2487851 | A | 8/2012 |
| GB | 2695923 | A | 5/2013 |
| GB | 2504732 | A | 2/2014 |
| IE | 63083 | B1 | 3/1995 |
| IT | 1289590 | B1 | 10/1998 |
| JP | S4961986 | A | 6/1974 |

(56) References Cited

FOREIGN PATENT DOCUMENTS

| | | | |
|---|---|---|---|
| JP | S5096908 | A | 8/1975 |
| JP | S5594260 | A | 7/1980 |
| JP | S57110260 | A | 7/1982 |
| JP | S57177769 | A | 11/1982 |
| JP | S63153666 | A | 6/1988 |
| JP | H01191674 | A | 8/1989 |
| JP | H01166953 | U | 11/1989 |
| JP | H0292986 | A | 4/1990 |
| JP | H03232481 | A | 10/1991 |
| JP | H0851175 | A | 2/1996 |
| JP | 2519658 | B2 | 7/1996 |
| JP | H08228751 | A | 9/1996 |
| JP | H08511175 | A | 11/1996 |
| JP | 3053426 | U | 10/1998 |
| JP | H11503912 | A | 4/1999 |
| JP | H11507234 | A | 6/1999 |
| JP | H11178562 | A | 7/1999 |
| JP | 2000051556 | A | 2/2000 |
| JP | 3016586 | B2 | 3/2000 |
| JP | 2000082576 | A | 3/2000 |
| JP | 2000093155 | A | 4/2000 |
| JP | 3078033 | B2 | 8/2000 |
| JP | 2000515576 | A | 11/2000 |
| JP | 3118462 | B2 | 12/2000 |
| JP | 3118463 | B2 | 12/2000 |
| JP | 2002170657 | A | 6/2002 |
| JP | 2002253593 | A | 9/2002 |
| JP | 2002336290 | A | 11/2002 |
| JP | 2003034785 | A | 2/2003 |
| JP | 3392138 | B2 | 3/2003 |
| JP | 2004504580 | A | 2/2004 |
| JP | 3588469 | B2 | 11/2004 |
| JP | 2005050624 | A | 2/2005 |
| JP | 2005516647 | A | 6/2005 |
| JP | 2006524494 | A | 11/2006 |
| JP | 2007516015 | A | 6/2007 |
| JP | 2007522900 | A | 8/2007 |
| JP | 2008509907 | A | 4/2008 |
| JP | 2008511175 | A | 4/2008 |
| JP | 2009509523 | A | 3/2009 |
| JP | 2009087703 | A | 4/2009 |
| JP | 2010041354 | A | 2/2010 |
| JP | 2010526553 | A | 8/2010 |
| JP | 2011135901 | A | 7/2011 |
| JP | 2012529936 | A | 11/2012 |
| JP | 2014526275 | A | 10/2014 |
| JP | 2015503336 | A | 2/2015 |
| JP | 2015503337 | A | 2/2015 |
| JP | 2015060837 | A | 3/2015 |
| JP | 2015506170 | A | 3/2015 |
| JP | 2015508287 | A | 3/2015 |
| JP | 2015509706 | A | 4/2015 |
| JP | 2016036222 | A | 3/2016 |
| JP | 2016525341 | A | 8/2016 |
| JP | 2017515490 | A | 6/2017 |
| JP | 2017520234 | A | 7/2017 |
| JP | 2017526381 | A | 9/2017 |
| JP | 2018520664 | A | 8/2018 |
| KR | 960702734 | A | 5/1996 |
| KR | 100385395 | B1 | 8/2003 |
| KR | 20040068292 | A | 7/2004 |
| KR | 20070096027 | A | 10/2007 |
| KR | 100971178 | B1 | 7/2010 |
| KR | 20120104533 | A | 9/2012 |
| KR | 20140068808 | A | 6/2014 |
| KR | 20140123487 | A | 10/2014 |
| SE | 7415242 | A | 6/1975 |
| SE | 502503 | L | 10/2006 |
| TW | 274507 | B | 4/1996 |
| TW | 201325481 | A | 7/2013 |
| WO | WO-8404698 | A1 | 12/1984 |
| WO | WO-8601730 | A1 | 3/1986 |
| WO | WO-9013326 | A1 | 11/1990 |
| WO | WO-9409842 | A1 | 5/1994 |
| WO | WO-9527411 | A1 | 10/1995 |
| WO | WO-9639880 | A1 | 12/1996 |
| WO | WO-9805906 | A1 | 2/1998 |
| WO | WO-9823171 | A1 | 6/1998 |
| WO | WO-9835552 | A1 | 8/1998 |
| WO | WO-9914402 | A1 | 3/1999 |
| WO | WO-9947273 | A2 | 9/1999 |
| WO | WO-9947806 | A2 | 9/1999 |
| WO | WO-0028843 | A1 | 5/2000 |
| WO | WO-0140717 | A1 | 1/2001 |
| WO | WO-0140717 | A1 | 6/2001 |
| WO | WO-0163183 | A1 | 8/2001 |
| WO | WO-0205620 | A2 | 1/2002 |
| WO | WO-0205640 | A1 | 1/2002 |
| WO | WO-0206421 | A1 | 1/2002 |
| WO | WO-0207656 | A2 | 1/2002 |
| WO | WO-0224262 | A2 | 3/2002 |
| WO | WO-02051466 | A2 | 7/2002 |
| WO | WO-02096532 | A1 | 12/2002 |
| WO | WO-02098389 | A1 | 12/2002 |
| WO | WO-03037412 | A2 | 5/2003 |
| WO | WO-03049792 | A1 | 6/2003 |
| WO | WO-03083007 | A2 | 10/2003 |
| WO | WO-2004098324 | A2 | 11/2004 |
| WO | WO-2004104491 | A2 | 12/2004 |
| WO | WO-2004104492 | A2 | 12/2004 |
| WO | WO-2004104493 | A2 | 12/2004 |
| WO | WO-2006022714 | A1 | 3/2006 |
| WO | WO-2007042941 | A2 | 4/2007 |
| WO | WO-2007051163 | A2 | 5/2007 |
| WO | WO-2007054167 | A1 | 5/2007 |
| WO | WO-2007078273 | A1 | 7/2007 |
| WO | WO-2007090594 | A1 | 8/2007 |
| WO | WO-2007098337 | A2 | 8/2007 |
| WO | WO-2007116915 | A1 | 10/2007 |
| WO | WO-2008015441 | A1 | 2/2008 |
| WO | WO-2008029381 | A2 | 3/2008 |
| WO | WO-200805909 | A1 | 5/2008 |
| WO | WO-2008089883 | A1 | 6/2008 |
| WO | WO-2008151777 | A2 | 12/2008 |
| WO | WO-2009006521 | A2 | 1/2009 |
| WO | WO-2009042955 | A2 | 4/2009 |
| WO | WO-2009079641 | A2 | 6/2009 |
| WO | WO-2009092862 | A1 | 7/2009 |
| WO | WO-2009118085 | A1 | 10/2009 |
| WO | WO-2009152651 | A1 | 12/2009 |
| WO | WO-2009155957 | A1 | 12/2009 |
| WO | WO-2009156181 | A2 | 12/2009 |
| WO | WO-2010017586 | A1 | 2/2010 |
| WO | WO-2010047389 | A | 4/2010 |
| WO | WO-2010053467 | A1 | 5/2010 |
| WO | WO-2010060537 | A1 | 6/2010 |
| WO | WO-2010107613 | A1 | 9/2010 |
| WO | WO-2011088132 | A1 | 7/2011 |
| WO | WO-2011101164 | A1 | 8/2011 |
| WO | WO-2011109304 | A2 | 9/2011 |
| WO | WO-2011117580 | A2 | 9/2011 |
| WO | WO-2012054973 | A1 | 5/2012 |
| WO | WO-2012072770 | A1 | 6/2012 |
| WO | WO-2012072790 | A1 | 6/2012 |
| WO | WO-2012078865 | A2 | 6/2012 |
| WO | WO-2012100430 | A1 | 8/2012 |
| WO | WO-2013034455 | A1 | 3/2013 |
| WO | WO-2013034458 | A1 | 3/2013 |
| WO | WO-2013076098 | A2 | 5/2013 |
| WO | WO-2013098395 | A1 | 7/2013 |
| WO | WO-2013098405 | A2 | 7/2013 |
| WO | WO-2013098409 | A1 | 7/2013 |
| WO | WO-2013098410 | A2 | 7/2013 |
| WO | WO-2013102609 | A2 | 7/2013 |
| WO | WO-2014048745 | A1 | 4/2014 |
| WO | WO-2015051646 | A1 | 4/2015 |
| WO | WO-2015068936 | A1 | 5/2015 |
| WO | WO-2015082648 | A1 | 6/2015 |
| WO | WO-2015131058 | A1 | 9/2015 |
| WO | WO-2015177044 | A1 | 11/2015 |
| WO | WO-2015177045 | A1 | 11/2015 |
| WO | WO-2015177255 | A1 | 11/2015 |
| WO | WO-2015177263 | A1 | 11/2015 |
| WO | WO-2015177264 | A1 | 11/2015 |

(56) References Cited

FOREIGN PATENT DOCUMENTS

| | | | |
|---|---|---|---|
| WO | WO-2015177265 | A1 | 11/2015 |
| WO | WO-2015177294 | A1 | 11/2015 |
| WO | WO-2015198015 | A1 | 12/2015 |
| WO | WO-2016014652 | A1 | 1/2016 |
| WO | WO-2016200815 | A2 | 12/2016 |
| WO | WO-2017001819 | A1 | 1/2017 |
| WO | WO-2017005705 | A1 | 1/2017 |
| WO | WO-2017029270 | A1 | 2/2017 |
| WO | WO-2017036955 | A2 | 3/2017 |
| WO | WO-2017036959 | A1 | 3/2017 |
| WO | WO-2017068099 | A1 | 4/2017 |
| WO | WO-2018002083 | A1 | 1/2018 |

OTHER PUBLICATIONS

Application and File History for U.S. Appl. No. 14/840,652, filed Aug. 31, 2015, inventors Blandino et al.
Application and File History for U.S. Appl. No. 14/840,703, filed Aug. 31, 2015, inventors Wilke et al..
Application and File History for U.S. Appl. No. 14/840,731, filed Aug. 31, 2015, inventors Blandino et al.
Application and File History for U.S. Appl. No. 14/840,751, filed Aug. 31, 2015, inventors Blandino et al.
Application and File History for U.S. Appl. No. 14/840,854, filed Aug. 31, 2015, inventors Blandino et al.
Application and File History for U.S. Appl. No. 14/840,972, filed Aug. 31, 2015, inventors Wilke et al.
Application and File History for U.S. Appl. No. 14/927,529, filed Oct. 30, 2015, inventors Kaufman et al.
Application and File History for U.S. Appl. No. 14/927,532, filed Oct. 30, 2015, inventors Blandino et al.
Application and File History for U.S. Appl. No. 14/927,537, filed Oct. 30, 2015, inventors Kaufman et al.
Application and File History for U.S. Appl. No. 14/927,539, filed Oct. 30, 2015, inventors Blandino et al.
Application and File History for U.S. Appl. No. 14/927,551, filed Oct. 30, 2015, inventors Blandino et al.
Application and File History for U.S. Appl. No. 14/927,556, filed Oct. 30, 2015, inventors Blandino et al.
Application and File History for U.S. Appl. No. 15/754,801, filed Feb. 23, 2018, inventors Blandino et al.
Application and File History for U.S. Appl. No. 15/754,809, filed Feb. 23, 2018, Inventors Wilke et al.
Application and File History for U.S. Appl. No. 15/754,812, filed Feb. 23, 2018, Inventors Blandino et al.
Application and File History for U.S. Appl. No. 15/754,818, filed. Feb. 23, 2018, Inventors Blandino et al.
Application and File History for U.S. Appl. No. 15/754,823, filed Feb. 23, 2018, Inventors Blandino et al.
Application and File History for U.S. Appl. No. 15/772,382, filed Apr. 30, 2018, Inventors Kaufman Wilke et al.
Application and File History for U.S. Appl. No. 15/772,386, filed Apr. 30, 2018, Inventors Blandino et al.
Chaplin M., "Hydrocolloids and Gums," retrieved from http://www1.lsbu.ac.uk/water/hydrocoiloids_gums.html, Established in 2001, 7 pages.
"Scientific Principles," University of Illinois, retrieved from http://matse1.matse.illinois.edu/ceramics/prin.html, Accessed on Jun. 15, 2017, 13 pages.
CN203762288U, "Atomization Device Applicable to Solid Tobacco Materials and Electronic Cigarette," retrieved from Google Patents https://patents.google.com/patent/CN203762288U/en on Jan. 12, 2018, 10 pages.
English translation of CN101390659 dated Aug. 3, 2017, 8 pages.
European Extended Search Report for Application No. 19216472.1 dated Apr. 22, 2020, 13 Pages.
European Notice of Opposition for Application No. 13759537 dated Jan. 23, 2020, 83 pages.
Extended European Search Report for Application No. 19164405.3 dated Aug. 28, 2019, 6 pages.
Extended European Search Report for Application No. 19165045.6 dated Sep. 6, 2019, 7 Pages.
First Office Action dated Nov. 1, 2019 for Chinese Application No. 2016800498584, 6 pages.
First Office Action dated Dec. 3, 2015 for Chinese Application No. 201380021387.2, filed Apr. 11, 2011, 20 pages.
First Office Action dated May 5, 2016 for Chinese Application No. 201380048636.7, 25 pages.
Gaohe Q., "Chinese Scientific Information," vol. 10, May 15, 2010, pp. 132-133.
Ineos., "Typical Engineering Properties of High Density Polyethylene," Olefins and Polymers, USA, retrieved from https://www.ineos.com/globalassets/ineos-group/businesses/ineos-olefins-and-polymers-usa/products/technical-information--patents/ineos-typical-engineering-properties-of-hdpe.pdf, Accessed Dec. 4, 2018, 2 pages.
International Preliminary Report on Patentability for Application No. PCT/EP2013/068797, dated Mar. 31, 2015, 5 pages.
International Preliminary Report on Patentability for Application No. PCT/EP2016/070176, dated Mar. 15, 2018, 12 pages.
International Preliminary Report on Patentability for Application No. PCT/EP2016/070178, dated Mar. 15, 2018, 8 pages.
International Preliminary Report on Patentability for Application No. PCT/EP2016/070182, dated Mar. 15, 2018, 8 pages.
International Preliminary Report on Patentability for Application No. PCT/EP2018/070185, dated Mar. 15, 2018, 11 pages.
International Preliminary Report on Patentability for Application No. PCT/EP2016/070188, dated Mar. 15, 2018, 8 pages.
International Preliminary Report on Patentability for Application No. PCT/EP2016/070191, dated Mar. 15, 2018, 8 pages.
International Preliminary Report on Patentability for Application No. PCT/EP2016/075734, dated May 11, 2018, 7 pages.
International Preliminary Report on Patentability for Application No. PCT/EP2016/075739, dated Jan. 16, 2018, 7 pages.
International Preliminary Report on Patentability for Application No. PCT/GB2013/052433, dated Mar. 24, 2015, 9 pages.
International Search Report and Written Opinion for Application No. PCT/EP2013/068797, dated Dec. 9, 2013, 8 pages.
International Search Report and Written Opinion for Application No. PCT/EP2016/070176, dated Apr. 19, 2017, 21 pages.
International Search Report and Written Opinion for Application No. PCT/EP2016/070178, dated Dec. 14, 2016, 10 pages.
International Search Report and Written Opinion for Application No. PCT/EP2016/070182, dated Dec. 12, 2016, 11 pages.
International Search Report and Written Opinion for Application No. PCT/EP2016/070185, dated Apr. 4, 2017, 16 pages.
International Search Report and Written Opinion for Application No. PCT/EP2016/070188, dated Dec. 13, 2016, 10 pages.
International Search Report and Written Opinion for Application No. PCT/EP2016/070191, dated Dec. 13, 2016, 10 pages.
International Search Report and Written Opinion for Application No. PCT/EP2016/075734, dated Apr. 6, 2017, 12 pages.
International Search Report and Written Opinion for Application No. PCT/EP2016/075739, dated Feb. 24, 2017, 10 pages.
International Search Report and Written Opinion for Application No. PCT/GB2013/052433, dated Jun. 30, 2014, 16 pages.
Iorga A., et al., "Low Curie Temperature in Fe—Cr—Ni—Mn Alloys," U.P.B. Sci.Bull., Series B, vol. 73 (4), 2011, pp. 195-202.
jrank.org, "Heat Capacity—Heat Capacity and Calorimetry, Heat Capacity and the Law of Conservation of Energy—Significance of the High Heat Capacity of Water," retrieved from https://science.jrank.org/pages/3265/Heat-Capacity.html, Accessed on Jun. 15, 2017, 2 pages.
Neomax Materials Co., Ltd., "NeoMax MS-135," retrieved from http://www.neomax-materials.co.jp/eng/pr0510.htm, as accessed on Oct. 30, 2015, 2 pages.
Notification of Reasons for Refusal dated Feb. 1, 2016 for Japanese Application No. 2015531544, 5 pages.
Office Action and Search Report dated May 6, 2020 for Chinese Application No. 2016800498156 filed Aug. 26, 2016, 7 pages.
Office Action and Search Report dated Feb. 25, 2020 for Taiwan Application No. 105127626 filed Aug. 29, 2016, 14 pages.

(56) References Cited

OTHER PUBLICATIONS

Office Action dated Oct. 18, 2019 for Chinese Application No. 201680049874.3, 18 pages.
Office Action dated Nov. 12, 2019 for Japanese Application No. 2018-506575, 8 pages.
Office Action dated Sep. 12, 2019 for Chilean Application No. 201800521, 8 pages.
Office Action dated Feb. 13, 2019 for Japanese Application No. 2018-507624, 32 pages.
Office Action dated Mar. 13, 2018 for Japanese Application No. 2017-075527, 10 pages.
Office Action dated Sep. 13, 2017 for Russian Application No. 2015106592, 6 pages.
Office Action dated Feb. 14, 2019 for Canadian Application No. 2996835, 3 pages.
Office Action dated Dec. 19, 2019 for Taiwan Application No. 105127627, 14 pages.
Office Action dated Feb. 19, 2019 for Canadian Application No. 2995315, 4 pages.
Office Action dated Mar. 19, 2019 for Japanese Application No. 2018-506553, 8 pages.
Office Action dated Mar. 19, 2019 for Japanese Application No. 2018-506565, 4 pages.
Office Action dated Mar. 19, 2019 for Japanese Application No. 2018-506575, 10 pages.
Office Action dated Oct. 21, 2019 for Chinese Application No. 2016800498156, 20 pages.
Office Action dated Jun. 25, 2019 for Japanese Application No. 2018-519865, 3 pages.
Office Action dated Jun. 25, 2019 for Japanese Application No. 2018-521547, 4 pages.
Office Action dated Mar. 26, 2019 for Japanese Application No. 2018-506381, 22 pages.
Office Action dated Mar. 28, 2019 for Canadian Application No. 3003514, 6 pages.
Office Action dated Aug. 29, 2019 for Korean Application No. 10-2018-7006009, 9 pages.
Office Action dated Oct. 29, 2019 Japanese Application No. 2018-507624, 29 pages.
Office Action dated Dec. 3, 2019 for Japanese Application No. 2018-521547, 4 pages.
Office Action dated Dec. 3, 2019 for Japanese Application No. 2018-506381, 8 pages.
Office Action dated Jan. 31, 2019 for Korean Application No. 10-2018-7006009, 17 pages.
Office Action dated Nov. 4, 2019 for Chinese Application No. 201680049679.0, 12 pages.
Office Action dated Nov. 5, 2019 for Japanese Application No. 2018-506553, 12 pages.
Office Action dated Nov. 5, 2019 for Japanese Application. No. 2018-506565, 12 pages.
Office Action dated Feb. 7, 2019 for Korean Application No. 10-2018-7006070, 9 pages.
Office Action dated May 7, 2019 for Japanese Application No. 2018-506563, 4 pages.
Office Action dated Feb. 8, 2019 for Korean Application No. 10-2018-7006077, 15 pages.
Office Action dated Jan. 8, 2018 for Japanese Application No. 2017-075527, 15 pages.
Office Action dated Jun. 9, 2020 for Chinese Application No. 201680061969.7, 15 pages.
"Polyetheretherketone—Online Catalog Source," Retrieved from http://www.goodfellow.com/A/Polyethertherketone.html, Jan. 17, 2020, 4 pages.
Rasidek N.A.M., et al., "Effect of Temperature on Rheology Behaviour of Banana Peel Pectin Extracted Using Hot Compressed Water," Jurnal Teknologi (Sciences & Engineering), vol. 80(3), Apr. 1, 2018, pp. 97-103.
Search Report dated Jan. 17, 2013 for Great Britain Application No. 1216621.1, 6 pages.
Second Office Action dated Jan. 16, 2017 for Chinese Application No. 201380048636.7, 24 pages.
The Engineering Toolbox., "Specific Heats for Metals," retrieved from https://www.engineeringtoolbox.com/specific-heat-metals-d_152.html, 2003, 6 pages.
Todaka T., et al., "Low Curie Temperature Material for Induction Heating Self-Temperature Controlling System," Journal of Magnetism and Magnetic Materials, vol. 320 (20), Oct. 2008, pp. e702-e707.
CN203762288, Machine Translation, retrieved Online from Espacenet on Aug. 13, 2020, (http://worldwide.espacenet.com), 5 pages.
Extended European Search Report for Application No. 20179569.7 dated Oct. 2, 2020, 10 pages.
Extended European Search Report for Application No. EP20205075.3, dated Jan. 27, 2021, 11 pages.
Jinshu Bangutai Jiagong Jishu, Metallurgical Industry Press, 10 pages, dated Jun. 30, 2012.
Office Action dated Aug. 5, 2020 for Chinese Application No. 201680049874.3, 6 pages.
Office Action for Chinese Application No. 201680049479.5, dated Feb. 4, 2021, 8 pages.
Office Action for Chinese Application No. 201680049858 dated Jul. 3, 2020, 35 pages.
Office Action dated Sep. 1, 2020 for Japanese Application No. 2018-506381, 25 pages.
Office Action dated Sep. 15, 2020 for Japanese Application No. 2019-118784, 14 pages.
Office Action dated Sep. 17, 2020 for Canadian Application No. 2996342, 4 pages.
Office Action dated Jun. 19, 2020 for Canadian Application No. 2995315, 4 pages.
Office Action dated Apr. 27, 2020 for the Brazilian Application No. 112017028539.8, 5 pages.
Office Action dated Sep. 29, 2020 for Japanese Application No. 2018-506563, 5 pages.
Office action dated Sep. 8, 2020 for Japanese Application No. 2018-507624, 7 pages.
Shuisheng X., et al., "Semisolid processing technology," Jinshu Bangutai Jiagong Jishu, 2012, ISBN 978-07-5024-5935-2, 10 pages.

* cited by examiner

MATERIAL FOR USE WITH APPARATUS FOR HEATING SMOKABLE MATERIAL

PRIORITY CLAIM

The present application is a National Phase entry of PCT Application No. PCT/EP2016/070191, filed Aug. 26, 2016, which claims priority from U.S. patent application Ser. No. 14/840,972, filed Aug. 31, 2015, each of which is hereby fully incorporated herein by reference.

TECHNICAL FIELD

The present disclosure relates to materials for use with apparatus for heating smokable material to volatilize at least one component of the smokable material, to articles for use with such apparatus and comprising such materials, to methods of manufacturing such materials, to methods of manufacturing such articles, and to systems comprising such articles and apparatuses.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present disclosure provides material for use with apparatus for heating smokable material to volatilize at least one component of the smokable material, the material comprising a mixture of smokable material and elements, each of the elements comprising a closed circuit of heating material that is heatable by penetration with a varying magnetic field.

In an exemplary embodiment, each of the elements is loop-shaped. In an exemplary embodiment, each of the elements is ring-shaped. In an exemplary embodiment, each of the elements is spherical. In an exemplary embodiment, each of the elements is formed from a plurality of discrete strands of the heating material. In an exemplary embodiment, each of the elements comprises a body that is free of heating material that is heatable by penetration with a varying magnetic field and that carries the closed circuit of heating material.

In an exemplary embodiment, each of the elements consists entirely, or substantially entirely, of the heating material.

In an exemplary embodiment, the heating material comprises one or more materials selected from the group consisting of: an electrically-conductive material, a magnetic material, and a non-magnetic material.

In an exemplary embodiment, the heating material comprises a metal or a metal alloy.

In an exemplary embodiment, the heating material comprises one or more materials selected from the group consisting of: aluminum, gold, iron, nickel, cobalt, conductive carbon, graphite, plain-carbon steel, stainless steel, ferritic stainless steel, copper, and bronze.

In an exemplary embodiment, each of the elements has a width of less than three millimeters. In an exemplary embodiment, each of the elements has a width of between one and two millimeters.

In an exemplary embodiment, the heating material is in contact with the smokable material.

In an exemplary embodiment, the smokable material comprises tobacco and/or one or more humectants.

A second aspect of the present disclosure provides material for use with apparatus for heating smokable material to volatilize at least one component of the smokable material, the material comprising a mixture of smokable material and open-cell structures of heating material that is heatable by penetration with a varying magnetic field.

In respective exemplary embodiments, the material may have any of the features of the above-described exemplary embodiments of the material of the first aspect of the present disclosure.

A third aspect of the present disclosure provides an article for use with apparatus for heating smokable material to volatilize at least one component of the smokable material, the article comprising a material comprising a mixture of smokable material and elements, wherein each of the elements comprises magnetic electrically-conductive material, and wherein the elements are aligned magnetically with each other.

In an exemplary embodiment, the article is elongate and the article has a circular cross-section.

In an exemplary embodiment, each of the elements has a central axis that is substantially aligned with a longitudinal axis of the article.

In an exemplary embodiment, each of the elements is ring-shaped, spherical, is formed from a plurality of discrete strands of magnetic electrically-conductive material, or comprises a non-conductive body carrying a closed circuit of magnetic electrically-conductive material.

In an exemplary embodiment, each of the elements comprises a closed circuit of the magnetic electrically-conductive material.

In an exemplary embodiment, the article comprises a cover around the mixture.

In an exemplary embodiment, the cover comprises a wrapper. In an exemplary embodiment, the cover comprises a sheet of paper.

In an exemplary embodiment, each of the elements has a maximum exterior dimension that is less than an interior dimension of the cover.

In an exemplary embodiment, the article comprises a mouthpiece defining a passageway that is in fluid communication with the material.

In an exemplary embodiment, the article comprises a temperature detector for detecting a temperature of the article. In some embodiments, the article comprises one or more terminals connected to the temperature detector for making connection with a temperature monitor of the apparatus in use.

A fourth aspect of the present disclosure provides an article for use with apparatus for heating smokable material to volatilize at least one component of the smokable material, the article comprising the material of the first aspect of the present disclosure or of the second aspect of the present disclosure.

In respective exemplary embodiments, the material of the article may have any of the features of the above-described exemplary embodiments of the material of the first aspect of the present disclosure.

In respective exemplary embodiments, the article may have any of the features of the above-described exemplary embodiments of the article of the second aspect of the present disclosure.

A fifth aspect of the present disclosure provides a method of manufacturing material for use with apparatus for heating smokable material to volatilize at least one component of the smokable material, the method comprising: providing smokable material; and mixing elements with the smokable material, wherein each of the elements comprises a closed circuit of heating material that is heatable by penetration with a varying magnetic field.

In an exemplary embodiment, the heating material comprises one or more materials selected from the group consisting of: an electrically-conductive material, a magnetic material, and a non-magnetic material.

In an exemplary embodiment, the heating material comprises a metal or a metal alloy.

In an exemplary embodiment, the heating material comprises one or more materials selected from the group consisting of: aluminum, gold, iron, nickel, cobalt, conductive carbon, graphite, plain-carbon steel, stainless steel, ferritic stainless steel, copper, and bronze.

In an exemplary embodiment, the heating material is a magnetic material.

In an exemplary embodiment, the method comprises magnetically aligning the elements with each other.

In an exemplary embodiment, each of the elements is ring-shaped. In an exemplary embodiment, each of the elements is spherical. In an exemplary embodiment, each of the elements is formed from a plurality of discrete strands of the heating material. In an exemplary embodiment, each of the elements comprises a body that is free of heating material that is heatable by penetration with a varying magnetic field and that carries the closed circuit of heating material.

In an exemplary embodiment, the smokable material comprises tobacco and/or one or more humectants.

In an exemplary embodiment, the mixing comprises mixing the elements with the smokable material to provide an even, or substantially even, disbursement of the elements throughout the material being manufactured.

A sixth aspect of the present disclosure provides a system, comprising: apparatus for heating smokable material to volatilize at least one component of the smokable material; and an article for use with the apparatus, wherein the article comprises a material comprising a mixture of smokable material and elements, wherein each of the elements comprises a closed circuit of heating material that is heatable by penetration with a varying magnetic field.

In an exemplary embodiment, the apparatus comprises an interface for cooperating with the article, and a magnetic field generator for generating a varying magnetic field for penetrating the heating material of the elements when the article is cooperating with the interface.

In respective exemplary embodiments, the article of the system may have any of the features of the above-described exemplary embodiments of the article of the third aspect of the present disclosure or of the fourth aspect of the present disclosure.

BRIEF DESCRIPTION OF THE DRAWINGS

Embodiments of the disclosure will now be described, by way of example only, with reference to the accompanying drawings, in which.

DETAILED DESCRIPTION

Figure 1:
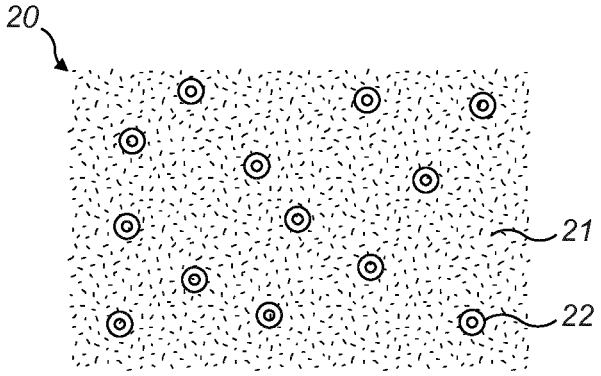
FIG. 1 shows a schematic view of an example of material for use with apparatus for heating smokable material to volatilize at least one component of the smokable material.

As used herein, the term "smokable material" includes materials that provide volatilized components upon heating, typically in the form of vapor or an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, liquid, gel, gelled sheet, powder, or agglomerates. "Smokable material" also may include other, non-tobacco, products, which, depending on the product, may or may not contain nicotine. "Smokable material" may comprise one or more humectants, such as glycerol or propylene glycol.

As used herein, the terms "heater material" and "heating material" refers to material that is heatable by penetration with a varying magnetic field.

As used herein, the terms "flavor" and "flavorant" refer to materials which, where local regulations permit, may be used to create a desired taste or aroma in a product for adult consumers. They may include extracts (e.g., licorice, *hydrangea*, Japanese white bark *magnolia* leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, gel, powder, or the like.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, material deposits on the object such as smokable material residue may be less of an issue, design freedom and control over the heating profile may be greater, and cost may be lower.

Referring to FIG. 1 there is shown a schematic view of an example of material according to an embodiment of the disclosure. The material 20 comprises a mixture of smokable material 21 and a plurality of elements 22, wherein each of the elements 22 comprises a closed circuit of heating material that is heatable by penetration with a varying magnetic field. The closed circuits of the elements 22 are heatable in use to heat the smokable material 21. In this embodiment, the elements 22 are dispersed throughout the material 20.

In this embodiment, the heating material is aluminum. However, in other embodiments, the heating material may comprise one or more materials selected from the group consisting of: an electrically-conductive material, a magnetic material, and a non-magnetic material. In some embodiments, the heating material may comprise a metal or a metal alloy. In some embodiments, the heating material may comprise one or more materials selected from the group consisting of: aluminum, gold, iron, nickel, cobalt, conductive carbon, graphite, plain-carbon steel, stainless steel, ferritic stainless steel, copper, and bronze. Other heating material(s) may be used in other embodiments. It has also been found that, when magnetic electrically-conductive material is used as the heating material, magnetic coupling between the magnetic electrically-conductive material and an electromagnet of the apparatus in use may be enhanced. In addition to potentially enabling magnetic hysteresis heating, this can result in greater or improved Joule heating of the heating material, and thus greater or improved heating of the smokable material 21.

In this embodiment, each of the elements 22 is loop-shaped. More specifically, in this embodiment, each of the elements 22 is ring-shaped. A loop-shaped element may be of any shape that defines a path that starts and ends at the same point so as to create a closed circuit, whereas a ring-shaped element necessarily is circular or substantially circular. A ring shaped element can have a large surface area to weight ratio, which can help to avoid the elements tending to cluster by settling due to gravity. A ring shaped element can have a small cross-sectional area to diameter ratio. Therefore, the circulating current in the ring when subjected to a varying magnetic field may penetrate most or all of the ring, rather than be confined to just a "skin" thereof as can be the case when a susceptor has too greater a thickness. Thus, a more efficient use of material is achieved and, in turn, costs are reduced. In this embodiment, each of the elements 22 consists entirely, or substantially entirely, of the heating material. However, in other embodiments, one or more of the elements 22 may comprise a loop- or ring-shaped body that is free of heating material and that carries the closed circuit of heating material. For example, one or more of the elements may comprise a ring-shaped body free of heating material with a closed-circuit of the heating material coated thereon.

In this embodiment, the closed circuit of each of the elements 22 is in contact with the smokable material 21. Thus, when the heating material of the closed circuits is heated by penetration with a varying magnetic field, heat may be transferred directly from the heating material of the closed circuits to the smokable material 21. In some other embodiments, the closed circuits may be kept out of contact with the smokable material 21. For example, in some embodiments, each of the elements 22 may comprise a thermally conductive barrier that is free of heating material and within which the closed circuit is embedded.

The heating material may have a skin depth, which is an exterior zone within which most of an induced electrical current and/or induced reorientation of magnetic dipoles occurs. By providing that the heating material has a relatively small thickness, a greater proportion of the heating material may be heatable by a given varying magnetic field, as compared to heating material having a depth or thickness that is relatively large as compared to the other dimensions of the heating material.

Figure 2:
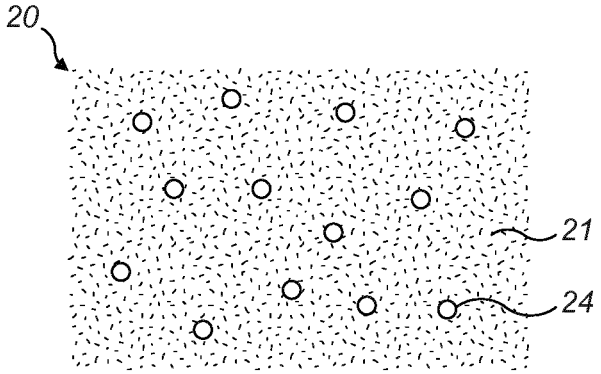
FIG. 2 shows a schematic view of an example of another material for use with apparatus for heating smokable material to volatilize at least one component of the smokable material.

Referring to FIG. 2 there is shown a schematic view of an example of another material according to an embodiment of the disclosure. The material 20 of FIG. 2 is identical to the material 20 of FIG. 1 except for the form of the elements in the material 20. Any of the above-described possible variations to the material 20 of FIG. 1 may be made to the material 20 of FIG. 2 to form separate respective embodiments.

In this embodiment, each of the elements 24 of the material 20 is spherical, and comprises a closed circuit of heating material. In this embodiment, each of the elements 24 comprises a body that is free of heating material and that carries the closed circuit of heating material. The closed circuits of the elements 24 are heatable in use to heat the smokable material 21.

In this embodiment, the closed circuit of each of the elements 24 is in contact with the smokable material 21. Thus, when the heating material of the closed circuits is heated by penetration with a varying magnetic field, heat may be transferred directly from the heating material of the closed circuits to the smokable material 21. In some other embodiments, the closed circuits may be kept out of contact with the smokable material 21. For example, in some embodiments, each of the elements 24 may comprise a body that is free of heating material and within which the closed circuit is embedded.

In a variation to this embodiment, each of the elements may be formed from a plurality of discrete strands of the heating material. That is, the strands may overlap and/or contact one another to define one or more closed circuits of the heating material. The strands may all be made of the same heating material. The strands may be linear or curved, for example, such as helical.

Figure 3:
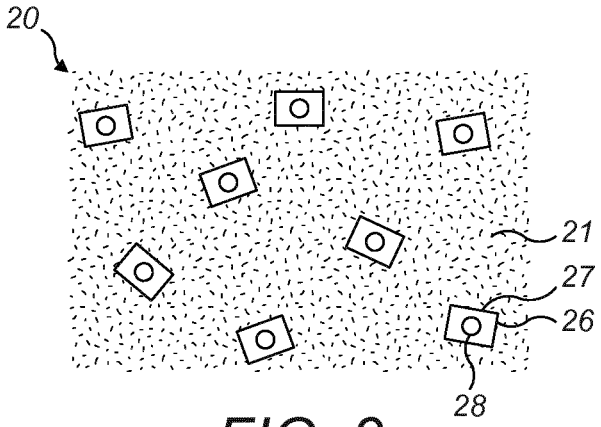
FIG. 3 shows a schematic view of an example of another material for use with apparatus for heating smokable material to volatilize at least one component of the smokable material.

Referring to FIG. 3 there is shown a schematic view of an example of another material according to an embodiment of the disclosure. The material 20 of FIG. 3 is identical to the material 20 of FIG. 1 except for the form of the elements in the material 20. Any of the above-described possible variations to the material 20 of FIG. 1 may be made to the material 20 of FIG. 3 to form separate respective embodiments.

In this embodiment, each of the elements 26 of the material 20 comprises a body 27 that is free of heating material and that carries a closed circuit 28 of heating material. The closed circuits 28 of the elements 26 are heatable in use to heat the smokable material 21.

In this embodiment, the closed circuit 28 of each of the elements 26 is in contact with the smokable material 21. Thus, when the heating material of the closed circuits 28 is heated by penetration with a varying magnetic field, heat may be transferred directly from the heating material of the closed circuits 28 to the smokable material 21. In some other embodiments, the closed circuits 28 may be kept out of contact with the smokable material 21. For example, in some embodiments, each of the elements 26 may comprise a body that is free of the heating material and within which the closed circuit 28 is embedded.

Figure 4:
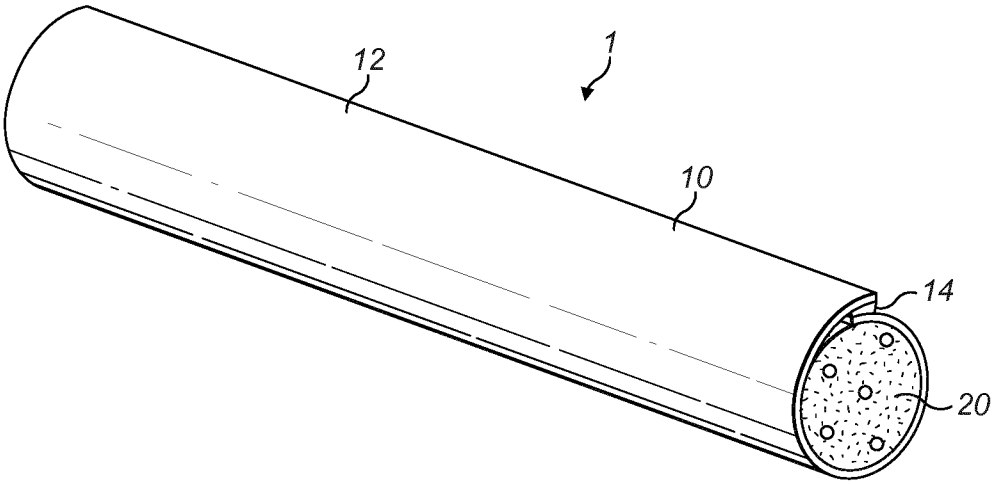
FIG. 4 shows a schematic perspective view of an example of an article for use with apparatus for heating smokable material to volatilize at least one component of the smokable material.
Figure 5:
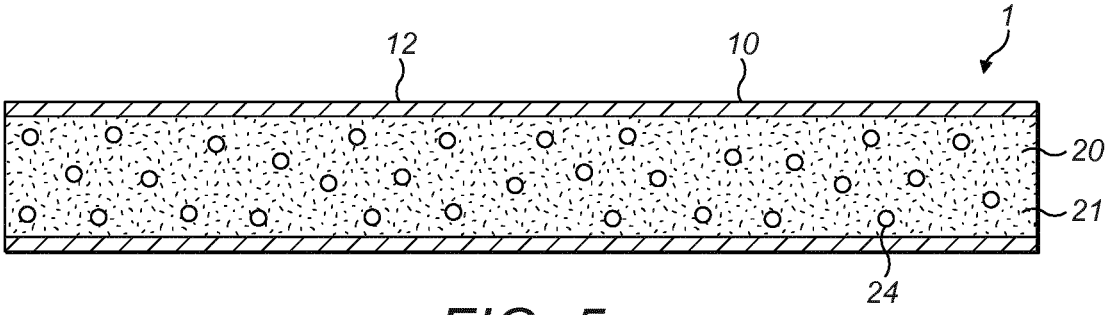
FIG. 5 shows a schematic cross-sectional view of the article of FIG. 4.

Referring to FIGS. 4 and 5 there are shown a schematic perspective view and a schematic cross-sectional view of an example of an article according to an embodiment of the disclosure. The article 1 comprises the material 20 of FIG. 2 and a cover 10 around the material 20. The article 1 is for use with apparatus for heating the smokable material 21 of the material 20 to volatilize at least one component of the smokable material 21 without burning the smokable material 21. An example such apparatus is described below. In a variation to this embodiment, each of the elements of the material 20 may be an open-cell structure or foam particle structure, a plate, or a granule. An open-cell structure or foam particle structure gives each of the elements a large surface area to weight ratio. Each open-cell structure or foam particle could have a width of less than three millimeters, such as between one and two millimeters.

In this embodiment, the cover 10 defines an outer surface of the article 1, which may contact the apparatus in use. In this embodiment, each of the elements 24 has a maximum exterior dimension that is less than an interior dimension of the cover 10. In this embodiment, the elements 24 are kept out of contact with the cover 10. This can help avoid singeing of the cover 10 as the elements 24 are heated in use. However, in other embodiments, one or more of the elements 24 may be in contact with the cover 10.

In this embodiment, the article 1 is elongate and cylindrical with a substantially circular cross section. However, in other embodiments, the article 1 may have a cross section other than circular and/or not be elongate and/or not be cylindrical. In this embodiment, the article 1 has proportions approximating those of a cigarette.

In this embodiment, the cover 10 comprises a wrapper 12 that comprises a sheet of material. In this embodiment, the sheet of material comprises a sheet of paper, but in other embodiments the sheet of material may be made of an electrically-insulating material other than paper, or an electrically-conductive material. In this embodiment, the cover 10 encircles the smokable material 21. In other embodiments, the cover 10 may also cover one or both longitudinal ends of the article. In this embodiment, the wrapper 12 is wrapped around the material 20 so that free ends of the wrapper 12 overlap each other. The wrapper 12 thus forms all of, or a majority of, a circumferential outer surface of the article 1.

The cover 10 of this embodiment also comprises an adhesive 14 that adheres the overlapped free ends of the wrapper 12 to each other to help prevent them from separating. In other embodiments, the adhesive 14 may be omitted. When such adhesive 14 is present, the combination of the wrapper 12 and the adhesive 14 may define an outer surface of the article 1 for contacting the apparatus. It is to be noted that the size of the adhesive 14 relative to the wrapper 12 is accentuated in FIG. 4 for clarity.

In some embodiments, the cover 10 may comprise a mass of thermal insulation. The thermal insulation may comprise one or more materials selected from the group consisting of: aerogel, vacuum insulation, wadding, fleece, non-woven material, non-woven fleece, woven material, knitted material, nylon, foam, polystyrene, polyester, polyester filament, polypropylene, a blend of polyester and polypropylene, cellulose acetate, paper or card, and corrugated material such as corrugated paper or card. The thermal insulation may additionally or alternatively comprise an air gap. Such thermal insulation can help prevent heat loss to components of the apparatus, and provide more efficient heating of the smokable material within the cover 10. In some embodiments, the insulation may have a thickness of up to one millimeter, such as up to 0.5 millimeters.

In a variation to this embodiment, each of the elements 24 comprises magnetic electrically-conductive material, and the elements 24 are aligned magnetically with each other. That is, magnetic dipoles within the elements 24 are aligned magnetically with each other. It has been found that, when the elements 24 are aligned magnetically with each other, magnetic coupling between the elements 24 and an electromagnet of the apparatus in use may be enhanced, which results in greater or improved Joule heating of the elements 24, and thus greater or improved heating of the smokable material 21. The same improvements may be provided by reducing a distance between the elements 24.

Figure 6:
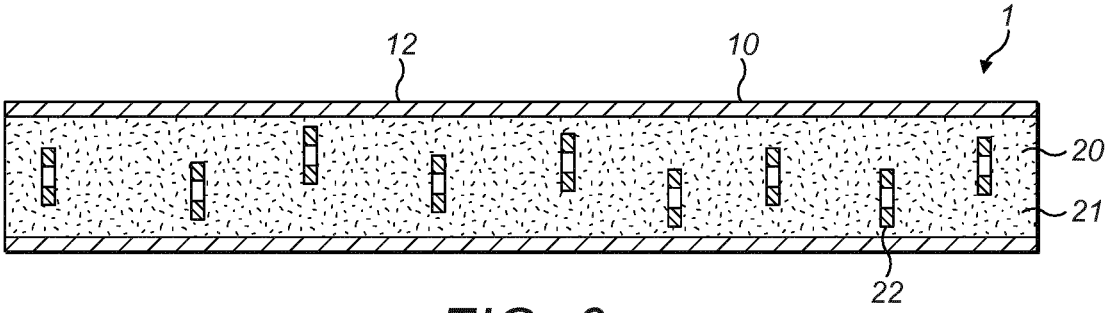
FIG. 6 shows a schematic cross-sectional view of an example of another article for use with apparatus for heating smokable material to volatilize at least one component of the smokable material.

Referring to FIG. 6 there is shown a schematic cross-sectional view of an example of another article according to an embodiment of the disclosure. The article 2 comprises a material 20 comprising a mixture of smokable material 21 and elements 22, and a cover 10 around the material 20. The article 2 of FIG. 6 is identical to the article 1 of FIGS. 4 and 5 except for the form of the elements in the material 20.

In this embodiment, each of the elements 22 comprises magnetic electrically-conductive material, and the elements 22 are aligned magnetically with each other. That is, magnetic dipoles within the elements 22 are aligned magnetically with each other. As noted above, it has been found that, when such elements 22 are aligned magnetically with each other, magnetic coupling between the elements 22 and an electromagnet of the apparatus in use may be enhanced, which results in greater or improved Joule heating of the elements 22, and thus greater or improved heating of the smokable material 21. The same improvements may be provided by reducing a distance between the elements 22.

In this embodiment, each of the elements 22 is ring-shaped. However, in respective variations to this embodiment, the elements may be loop-shaped, open-cell structures, or comprise a non-conductive body carrying a closed circuit of magnetic electrically-conductive material. In this embodiment, each of the elements 22 has a central axis that is substantially aligned with a longitudinal axis of the article 2. In other embodiments, the central axes of the elements 22 may be non-parallel to the longitudinal axis of the article 2. In some embodiments, the central axes of the elements 22 may be perpendicular to the longitudinal axis of the article 2. In this embodiment, each of the elements 22 has a maximum exterior dimension that is less than an interior dimension of the cover 10.

In some embodiments, each of the elements 22 may comprise a closed circuit of magnetic electrically-conductive material. As noted above, it has been found that, when a magnetic susceptor is in the form of a closed circuit, magnetic coupling between the susceptor and an electromagnet in use may be enhanced to provide greater or improved Joule heating of the elements 22.

In some embodiments, the heating material may not be susceptible to eddy currents being induced therein by penetration with a varying magnetic field. In such embodiments, the heating material may be a magnetic material that is non-electrically-conductive, and thus may be heatable by the magnetic hysteresis process discussed above.

Figure 7:
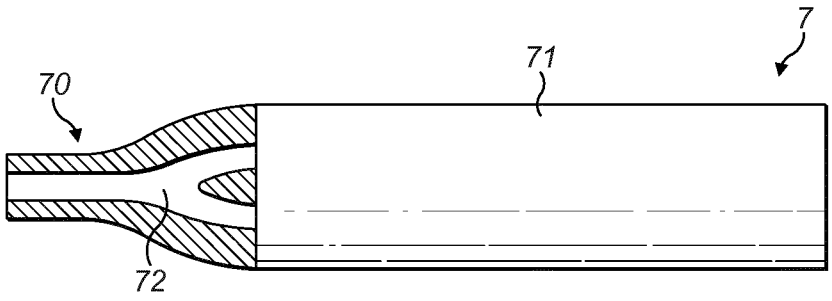
FIG. 7 shows a schematic partial cross-sectional view of an example of another article for use with apparatus for heating smokable material to volatilize at least one component of the smokable material.

In some embodiments, the article comprises a mouthpiece defining a passageway that is in fluid communication with the material 20. Referring to FIG. 7, there is shown a schematic partial cross-sectional view of an example of an article 7 according to an embodiment of the disclosure. The section of the article 7 numbered 71 could comprise either of the constructions shown in FIGS. 4 to 6 or any of the variants thereof discussed above. The mouthpiece 70 and passageway 72 thereof are shown connected to the construction with the passageway 72 aligned so as to be in fluid communication with the material 20 of the construction. The mouthpiece 70 may be made of any suitable material, such as a plastics material, cardboard or rubber.

In use, when the smokable material 21 is heated by the heated elements 22, 24, volatilized components of the smokable material 21 can be readily inhaled by a user. In embodiments in which the article is a consumable article, once all or substantially all of the volatilizable component(s) of the smokable material 21 in the article has/have been spent, the user may dispose of the mouthpiece together with the rest of the article. This can be more hygienic than using the same mouthpiece with multiple articles, can help ensure that the mouthpiece is correctly aligned with the smokable material, and presents a user with a clean, fresh mouthpiece each time they wish to use another article.

The mouthpiece 70, when provided, may comprise or be impregnated with a flavorant. The flavorant may be arranged so as to be picked up by heated vapor as the vapor passes through the passageway 72 of the mouthpiece 70 in use.

Figure 8:
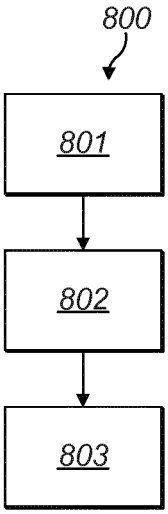
FIG. 8 is a flow diagram showing an example of a method of manufacturing material for use with apparatus for heating smokable material to volatilize at least one component of the smokable material.

Referring to FIG. 8 there is shown a flow diagram of an example of a method according to an embodiment of the disclosure of manufacturing material for use with apparatus for heating smokable material to volatilize at least one component of the smokable material. The method may be used to manufacture the above-described materials 20 of FIGS. 1 to 3, respectively.

The method 800 comprises providing 801 smokable material 21, and then mixing 802 elements 22, 24, 26 with the smokable material 21. For example, the smokable material 21 and elements 22, 24, 26 may be provided to a hopper and mixed therein. Preferably, the smokable material 21 and elements 22, 24, 26 are mixed so as to ensure that the elements 22, 24, 26 are evenly, or substantially evenly, dispersed throughout the smokable material 21. Alternatively, the elements 22, 24, 26 may be contained in a hopper, then dropped from the hopper into a feed of the smokable material 21. Such dropping or a subsequent additional mixing step ensure that the elements 22, 24, 26 are evenly, or substantially evenly, dispersed throughout the mixture. Each of the elements 22, 24, 26 comprises a closed circuit of heating material. Each of the elements 22, 24, 26 may, for example, be ring-shaped, be spherical, be formed from a plurality of discrete strands of the heating material, or comprise a body that is free of heating material and that carries the closed circuit of heating material.

In this embodiment, the heating material of the elements 22, 24, 26 is electrically-conductive magnetic material, and the method comprises magnetically aligning 803 the elements 22, 24, 26 with each other. Such magnetic alignment may be carried out by subjecting the elements 22, 24, 26 to a strong magnetic field. As noted above, when the elements 22, 24, 26 are aligned magnetically with each other, in use magnetic coupling between the elements 22, 24, 26 and an electromagnet of an apparatus may be enhanced, which results in greater or improved Joule heating of the elements 22, 24, 26, and thus greater or improved heating of the smokable material 21 of the material 20. Moreover, reducing a distance between the elements 24 may provide the same advantages. Those elements 22, 24, 26 whose axis is parallel to the magnetic field will be the most excitable. Spherical elements 22, 24, 26 may be more readily magnetically aligned, since their rotation in the mixture with the smokable material 21 would be less hindered by the shape of the elements 22, 24, 26 than in the case of non-spherical elements 22, 24, 26.

In other embodiments, such magnetic aligning 803 of elements 22, 24, 26 with each other may be omitted. In such other embodiments, the heating material may comprise one or more materials selected from the group consisting of: an electrically-conductive material, a magnetic material, and a non-magnetic material. The heating material may comprise a metal or a metal alloy. The heating material may comprise one or more materials selected from the group consisting of:

aluminum, gold, iron, nickel, cobalt, conductive carbon, graphite, plain-carbon steel, stainless steel, ferritic stainless steel, copper, and bronze.

Figure 9:
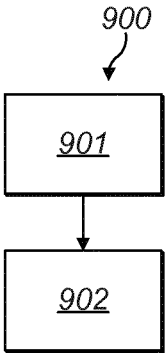
FIG. 9 is a flow diagram showing an example of a method of manufacturing an article for use with apparatus for heating smokable material to volatilize at least one component of the smokable material.

Referring to FIG. 9 there is shown a flow diagram of an example of a method according to an embodiment of the disclosure of manufacturing an article for use with apparatus for heating smokable material to volatilize at least one component of the smokable material. The method may be used to manufacture the above-described article 2 of FIG. 6.

The method 900 comprises performing 901 the method 800 of FIG. 8, and then providing 902 a cover 10 around the material 20 so that the cover 10 defines the outer surface of the article 2.

In a variation to this method 900, the magnetic aligning 803 of elements 22, 24, 26 with each other may be omitted as noted above. Such a variation to the method could be used to manufacture the above-described article 1 of FIGS. 4 and 5. In some embodiments, the elements 22, 24, 26 may be magnetically levitated within the smokable material during manufacture of the article, to help avoid clustering of the elements 22, 24, 26 due to settling under the influence of gravity.

Each of the above-described articles 1, 2 and described variants thereof may be used with an apparatus for heating the smokable material 21 to volatilize at least one component of the smokable material 21. The apparatus may be to heat the smokable material 21 to volatilize the at least one component of the smokable material 21 without burning the smokable material 21. Any one of the article(s) 1, 2 and such apparatus may be provided together as a system. The system may take the form of a kit, in which the article 1, 2 is separate from the apparatus. Alternatively, the system may take the form of an assembly, in which the article 1, 2 is combined with the apparatus.

The apparatus may comprise a magnetic field generator for generating a varying magnetic field for heating the heating material of the elements 22, 24 of the article 1, 2. Such magnetic field generator may comprise an electrical power source, a coil, a device for passing a varying electrical current, such as an alternating current, through the coil, a controller, and a user interface for user-operation of the controller. The electrical power source may be a rechargeable battery, a non-rechargeable battery, a connection to a mains electricity supply, or the like.

The coil may take any suitable form, such as a helical coil of electrically-conductive material, such as copper. The magnetic field generator may comprise a magnetically permeable core around which the coil is wound, to concentrate the magnetic flux produced by the coil and make a more powerful magnetic field. The magnetically permeable core may be made of iron, for example. In some embodiments, the magnetically permeable core may extend only partially along the length of the coil, so as to concentrate the magnetic flux only in certain regions.

The device for passing a varying electrical current through the coil may be electrically connected between the electrical power source and the coil. The controller may be electrically connected to the electrical power source, and be communicatively connected to the device to control the device, so as to control the supply of electrical power from the electrical power source to the coil. In some embodiments, the controller may comprise an integrated circuit (IC), such as an IC on a printed circuit board (PCB). In other embodiments, the controller may take a different form. In some embodiments, the apparatus may have a single electrical or electronic component comprising the device and the controller. The controller may be operated by user-operation of the user interface, which may comprise a push-button, a toggle switch, a dial, a touchscreen, or the like. Operation of the user interface by a user may cause the controller to cause the device to apply an alternating electric current across the coil, so as to cause the coil to generate an alternating magnetic field.

The apparatus may have a recess or other interface for receiving the article 1, 2 and the coil may be positioned relative to the recess or interface so that the varying or alternating magnetic field produced by the coil in use penetrates the recess or interface at a location corresponding to the heating material of the article 1, 2 when the article 1, 2 is in the recess or cooperating with the interface. When the heating material of the article 1, 2 is an electrically-conductive material, this may cause the generation of one or more eddy currents in the heating material of the elements 22, 24 of the article 1, 2. The flow of eddy currents in the heating material against the electrical resistance of the heating material of the elements 22, 24 of the article 1, 2 causes the heating material of the elements 22, 24 of the article 1, 2 to be heated by Joule heating. When the heating material of the elements 24 of the article 1 shown in FIG. 5 is a magnetic material, the orientation of magnetic dipoles in the heating material changes with the changing applied magnetic field, which causes heat to be generated in the heating material of the elements 22, 24 of the article 1, 2 by magnetic hysteresis heating.

The apparatus may have a mechanism for compressing the article 1, 2 when the article 1, 2 is inserted in the recess or cooperating with the interface. Such compression of the article 1, 2 can compress the smokable material 21, so as to increase the thermal conductivity of the smokable material 21. In other words, compression of the smokable material 21 can provide for higher heat transfer through the article 1, 2.

The apparatus may have a temperature sensor for sensing a temperature of the recess, interface, or article 1, 2 in use. The temperature sensor may be communicatively connected to the controller, so that the controller is able to monitor the temperature. In some embodiments, the temperature sensor may be arranged to take an optical temperature measurement of the recess, interface or article. In some embodiments, the article 1, 2 may comprise a temperature detector, such as a resistance temperature detector (RTD), for detecting a temperature of the article 1, 2. The article 1, 2 may further comprise one or more terminals connected, such as electrically-connected, to the temperature detector. The terminal(s) may be for making connection, such as electrical connection, with a temperature monitor of the apparatus when the article 1, 2 is in the recess or cooperating with the interface. The controller may comprise the temperature monitor. The temperature monitor of the apparatus may thus be able to determine a temperature of the article 1, 2 during use of the article 1, 2 with the apparatus.

In some embodiments, by providing that the heating material of the article 1, 2 has a suitable resistance, the response of the heating material to a change in temperature could be sufficient to give information regarding temperature inside the article 1, 2. The temperature sensor of the apparatus may then comprise a probe for analyzing the heating material.

On the basis of one or more signals received from the temperature sensor or temperature detector, the controller may cause the device to adjust a characteristic of the varying or alternating current passed through the coil as necessary, in order to ensure that the temperature remains within a predetermined temperature range. The characteristic may be, for example, amplitude or frequency. Within the predetermined temperature range, in use the smokable material 21 within an article 1, 2 inserted in the recess or cooperating with the interface may be heated sufficiently to volatilize at least one component of the smokable material 21 without combusting the smokable material 21. In some embodiments, the temperature range is about 50° C. to about 250° C., such as between about 50° C. and about 150° C., between about 50° C. and about 120° C., between about 50° C. and about 100° C., between about 50° C. and about 80° C., or between about 60° C. and about 70° C. In some embodiments, the temperature range is between about 170° C. and about 220° C. In other embodiments, the temperature range may be other than this range. The apparatus may have a delivery device for delivering the volatilized component(s) of the smokable material 21 to a user.

The apparatus may define an air inlet that fluidly connects the recess or interface with an exterior of the apparatus. A user may be able to inhale the volatilized component(s) of the smokable material by drawing the volatilized component (s) through a channel, such as a channel of a mouthpiece of the apparatus. As the volatilized component(s) are removed from the article 1, 2, air may be drawn into the recess or interface via the air inlet of the apparatus.

The apparatus may provide haptic feedback to a user. The feedback could indicate that heating of the susceptor is taking place, or be triggered by a timer to indicate that greater than a predetermined proportion of the original quantity of volatilizable component(s) of the smokable material 21 in the article 1, 2 has/have been spent, or the like. The haptic feedback could be created by interaction of the susceptor with the coil (i.e. magnetic response), by interaction of an electrically-conductive element with the coil, by rotating an unbalanced motor, by repeatedly applying and removing a current across a piezoelectric element, or the like.

The apparatus may comprise more than one coil. The plurality of coils could be operated to provide progressive heating of the smokable material 21 in an article 1, 2, and thereby progressive generation of vapor. For example, one coil may be able to heat a first region of the heating material relatively quickly to initialize volatilization of at least one component of the smokable material 21 and formation of vapor in a first region of the smokable material 21. Another coil may be able to heat a second region of the heating material relatively slowly to initialize volatilization of at least one component of the smokable material 21 and formation of vapor in a second region of the smokable material 21. Accordingly, vapor is able to be formed relatively rapidly for inhalation by a user, and vapor can continue to be formed thereafter for subsequent inhalation by the user even after the first region of the smokable material 10 may have ceased generating vapor. The initially-unheated second region of smokable material 21 could act as a filter, to reduce the temperature of created vapor or make the created vapor mild, during heating of the first region of smokable material 21.

In some embodiments, the heating material may comprise discontinuities or holes therein. Such discontinuities or holes may act as thermal breaks to control the degree to which different regions of the smokable material are heated in use. Areas of the heating material with discontinuities or holes therein may be heated to a lesser extent that areas without discontinuities or holes. This may help progressive heating of the smokable material, and thus progressive generation of vapor, to be achieved.

In each of the above described embodiments, the smokable material 21 comprises tobacco. However, in respective variations to each of these embodiments, the smokable material 21 may consist of tobacco, may consist substantially entirely of tobacco, may comprise tobacco and smokable material other than tobacco, may comprise smokable material other than tobacco, or may be free of tobacco. In some embodiments, the smokable material 21 may comprise a vapor or aerosol forming agent or a humectant, such as glycerol, propylene glycol, triactein, or diethylene glycol.

An article embodying the present disclosure may be a cartridge or a capsule, for example.

In each of the above described embodiments, the article 1, 2 is a consumable article. Once all, or substantially all, of the volatilizable component(s) of the smokable material 21 in the article 1, 2 has/have been spent, the user may remove the article 1, 2 from the apparatus and dispose of the article 1, 2. The user may subsequently re-use the apparatus with another of the articles 1, 2. However, in other respective embodiments, the article 1, 2 may be non-consumable, and the apparatus and the article 1, 2 may be disposed of together once the volatilizable component(s) of the smokable material 21 has/have been spent.

In some embodiments, the apparatus discussed above is sold, supplied or otherwise provided separately from the articles 1, 2 with which the apparatus is usable. However, in some embodiments, the apparatus and one or more of the articles 1, 2 may be provided together as a system, such as a kit or an assembly, possibly with additional components, such as cleaning utensils.

Embodiments of the disclosure could be implemented in a system comprising any one of the articles discussed herein, and any one of the apparatuses discussed herein, wherein the apparatus itself further has heating material, such as in a susceptor, for heating by penetration with the varying magnetic field generated by the magnetic field generator. Heat generated in the heating material of the apparatus itself could be transferred to the article to further heat the smokable material therein.

In order to address various issues and advance the art, the entirety of this disclosure shows by way of illustration and example various embodiments in which the claimed invention may be practiced and which provide for superior material for use with apparatus for heating smokable material to volatilize at least one component of the smokable material, superior articles for use with such apparatus and comprising such material, superior methods of manufacturing such material, superior methods of manufacturing such articles, and superior systems comprising such articles and such apparatus. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An article configured for use with an apparatus configured to heat a smokable material and volatilize at least one component of the smokable material, the article comprising:

a material including a mixture of the smokable material and a plurality of elements, each element of the plurality of elements comprising magnetic electrically-conductive material, and wherein the elements of the plurality of elements are aligned magnetically with each other within the article.

2. The article of claim 1, wherein each element of the plurality of elements has a central axis that is substantially aligned with a longitudinal axis of the article.

3. The article of claim 1, wherein each element of the plurality of elements is ring-shaped, spherical, is formed from a plurality of discrete strands of magnetic electrically-conductive material, or comprises a non-conductive body carrying a closed circuit of the magnetic electrically-conductive material.

4. The article of claim 1, wherein each element of the plurality of elements comprises a closed circuit of the magnetic electrically-conductive material.

5. A method of manufacturing material for use with an apparatus configured to heat a smokable material to volatilize at least one component of the smokable material, the method comprising:

providing the smokable material; and mixing a plurality of elements with the smokable material, each of the elements comprising a closed circuit of heating material that is heatable by penetration with a varying magnetic field;

wherein the heating material is a magnetic material, and the method further comprises magnetically aligning the elements with each other.

6. The method of claim 5, wherein each of the elements is ring-shaped, spherical, is formed from a plurality of discrete strands of the heating material, or comprises a body that is free of heating material that is heatable by penetration with a varying magnetic field and that carries the closed circuit of heating material.

7. The method of claim 5, wherein the smokable material comprises at least one of tobacco or one or more humectants.

8. The method of claim 5, wherein the mixing comprises mixing the plurality of elements with the smokable material to provide an even, or substantially even, disbursement of the plurality of elements throughout a material being manufactured.

9. A system, comprising:

an apparatus configured to heat smokable material to volatilize at least one component of the smokable material; and an article configured for use with the apparatus, the article comprising:

a material including a mixture of smokable material and a plurality of elements, each element of the plurality of elements comprising magnetic electronically-conductive conductive material, and wherein the elements of the plurality of elements are aligned magnetically with each other within the article, wherein the apparatus comprises a magnetic field generator configured to, in use, generate a varying magnetic field that penetrates the magnetic electrically-conductive material of the plurality of elements.

10. The system of claim 9, wherein the apparatus comprises an interface configured to cooperate with the article, and the magnetic field generator generates the varying magnetic field when the article cooperates with the interface.

* * * * *